US008418937B2

(12) United States Patent
Staedtler

(10) Patent No.: US 8,418,937 B2
(45) Date of Patent: Apr. 16, 2013

(54) JET REGULATOR

(75) Inventor: Georg Staedtler, Bad Rodach/Gauerstadt (DE)

(73) Assignee: Neoperl GmbH, Muellheim (DE)

( * ) Notice: Subject to any disclaimer, the term of this patent is extended or adjusted under 35 U.S.C. 154(b) by 246 days.

(21) Appl. No.: 12/681,056

(22) PCT Filed: Sep. 26, 2008

(86) PCT No.: PCT/EP2008/008219

§ 371 (c)(1),
(2), (4) Date: Mar. 31, 2010

(87) PCT Pub. No.: WO2009/046890

PCT Pub. Date: Apr. 16, 2009

(65) Prior Publication Data

US 2010/0213283 A1 Aug. 26, 2010

(30) Foreign Application Priority Data

Oct. 1, 2007 (DE) ..... 10 2007 047 112

(51) Int. Cl.
*E03C 1/08* (2006.01)

(52) U.S. Cl.
USPC ..... 239/428.5; 239/518; 239/553.5

(58) Field of Classification Search ..... 239/428.5, 239/498–500, 502, 504–506, 516, 518–522, 239/552, 553, 553.5, 590, 590.5
See application file for complete search history.

(56) References Cited

U.S. PATENT DOCUMENTS

| | | | | |
|---|---|---|---|---|
| 2,044,445 | A * | 6/1936 | Price et al. | 239/458 |
| 3,747,856 | A * | 7/1973 | Knapp | 239/428.5 |
| 6,126,093 | A | 10/2000 | Grether et al. | |
| 2005/0189289 | A1 | 9/2005 | Hsiao | |
| 2008/0289708 | A1 | 11/2008 | Schmidt et al. | |
| 2009/0230216 | A1 | 9/2009 | Staedtler | |

FOREIGN PATENT DOCUMENTS

| | | | |
|---|---|---|---|
| DE | 203 17 910 | U1 | 3/2004 |
| DE | 10 2005 061 974 | B3 | 6/2007 |
| EP | 0 721 031 | A1 | 7/1996 |
| WO | WO 98/16694 | A1 | 4/1998 |
| WO | WO 2008/037341 | A1 | 4/2008 |

OTHER PUBLICATIONS

International Search Report dated Feb. 9, 2009 with English translation (Ten (10) pages).

* cited by examiner

*Primary Examiner* — Christopher Kim
(74) *Attorney, Agent, or Firm* — Crowell & Moring LLP

(57) ABSTRACT

A jet regulator for accommodating a water flow, comprises, a distributor surface having a plurality of through-flow holes for distributing the water flow; a rebounding surface arranged in a central region of a flow cross-section; and a plurality of flow guiding walls connected downstream of the distributor surface, and oriented in a flow direction.

7 Claims, 2 Drawing Sheets

II
II
1
2
3
4
5
6
7
8
9
10

JET REGULATOR

BACKGROUND OF THE INVENTION

This application is a national stage of PCT International Application No. PCT/EP2008/008219, filed Sep. 26, 2008, which claims priority under 35 U.S.C. §119 to German Patent Application No. 10 2007 047 112.4, filed Oct. 1, 2007, the entire disclosures of which are herein expressly incorporated by reference.

The invention relates to a jet regulator of a type usually produced as an insert-type cartridge, which can be mounted in the region of the water outlet of a sanitary outlet fitting in order to shape a homogeneous and non-spraying water jet.

Such jet regulators are produced either as aerated jet regulators or as laminar (i.e., unaerated) functional units, and usually have a circular cross-section. However, fan jet regulators are also increasingly being developed and produced, which have the purpose of producing a flat band-shaped water jet that is dimensionally stable over a distance that is as long as possible. Because of the noncircular design, usually no external thread can be provided on the outer periphery of such flat-jet regulators in order to be able to fix the jet regulator in the region of the water outlet of an outlet fitting. Since the jet regulators mounted in the water outlet may possibly also be subjected to a comparatively high water pressure, other fixing devices, such as headless screws, are required, which fix the jet regulator in the interior of the fitting housing through the exterior side of the fitting housing. If such fixing devices must not impair the appearance of a sanitary outlet fitting, and should therefore not be visible, the application possibilities will be limited.

SUMMARY OF THE INVENTION

It is therefore an object of the present invention to provide a jet regulator of the initially mentioned type which is characterized by a homogenous jet pattern and is to be usable in a manner that is as versatile as possible.

This and other objects and advantages are achieved by the jet regulator according to the invention, which has a distributor surface comprising a plurality of through-flow holes for distributing the water jet. Because the distributor surface only distributes the water jet, and does not pose an excessively large resistance to it, large holding forces will not build up in the case of a comparatively high inflow-side pressure, which holding forces would have to be transmitted toward the fitting wall.

A rebounding surface, which is arranged in a central region of the jet cross-section, and is connected downstream of the distributor surface, deflects the water jet from the central region additionally to the edge regions of the clear through-flow cross-sections. Flow guiding walls are in turn connected downstream of the rebounding surface in the flow direction and shape the flowing water into a uniform and homogenous flowing-out water jet.

The jet regulator according to the invention provides a homogenous jet pattern. Since the components of the jet regulator according to the invention do not pose any excessively large resistance to the water jet, the expenditures required for securing the jet regulator in the fitting house can be considerably reduced.

It is also possible to use the jet regulator in a flow guide with a through-flow cross section that remains constant on the inflow side and, in particular, is rectangular. However, it is advantageous for the jet regulator to be arranged directly downstream of a cross-sectional expansion of the flow guide in the flow direction. Since the distributor surface is also capable of absorbing the high water pressure of a water jet that may be concentrated on a comparatively small jet cross-section, such a water jet can also be distributed over a comparatively large cross-section by means of the jet regulator according to the invention.

A homogenous jet pattern will be promoted when the flow guiding walls are arranged approximately parallel to one another.

In order to easily deflect the water jet already distributed by the distributor surface also into the edge areas of the jet cross-section, it is advantageous for at least one partial quantity of the flow guiding walls to carry the rebounding surface.

Good flow guidance in the region of the flow-guiding walls is promoted if at least two opposite circumferential sides of the rebounding surface and/or the inflow-side narrow edges of the flow guiding walls projecting beyond the rebounding surface have a truncated-cone-shaped side contour.

In order to increase the stability of the jet regulator according to the invention also in the region of the flow guiding walls, and in order always to ensure a constant distance between the flow guiding walls, it is advantageous for the flow guiding walls to be mutually connected by way of at least one connecting wall which is preferably central and, in particular, extends through the longitudinal center axes of the flow guiding walls.

A homogeneous and non-spraying jet pattern is promoted when the connecting and/or flow guiding walls taper at least in a flow-off-side partial region in the flow direction and/or are rounded at their flow-off-side narrow edges.

The expenditures for manufacturing the jet regulator according to the invention are reduced when the connecting and flow guiding walls, as well as the rebounding surface, are arranged in the sleeve interior of a sleeve-shaped jet regulator housing and are preferably molded in as one piece. In this case, in a preferred embodiment according to the invention, the distributor surface is constructed as a perforated plate which can be placed on the jet regulator housing.

Since the components of the jet regulator according to the invention do not pose an excessively large resistance to the inflowing water jet, no large holding forces, which must be transmitted toward the fitting wall, will build up, even at a comparatively high inflow-side pressure. This considerably reduces the expenditures required for securing the jet regulator according to the invention in the fitting housing.

In order to be able to easily releasably insert the jet regulator according to the invention into the fitting housing, if required, and to hold it there possibly also solely in a frictionally engaged manner; and in order to be able to do without additional fixing devices that may also have a disturbing effect, in a preferred further embodiment of the invention a flow regulator or a flow limiting device is provided in front of the jet regulator in the flow direction at a distance from the jet regulator. By means of such a flow regulator, the water pressure acting upon the jet regulator can be advantageously limited.

A frictionally engaged fixing of the jet regulator according to the invention has the additional advantage that is makes it possible to seal between the jet regulator and the inner periphery of the fitting. Since no high inflow-side pressures build up in the jet regulator according to the invention, a separate soft packing is also unnecessary.

Secure frictional engagement of connection between the inner periphery of the fitting housing and the jet regulator according to the invention, on the other hand, is promoted when at least one spring web is provided on the outer periphery of the jet regulator housing and acts upon the inner periphery of the water outlet. Such a spring web can pressurize the fitting housing on the inner periphery side with a stable frictional engagement.

In this case, the holding forces can be significantly improved by means of such a spring web when, in the use position, the spring web also reaches form-lockingly behind an undercut on the inner periphery of the fitting.

It is particularly advantageous to arrange a surrounding spring web on the outer periphery of the jet regulator housing, preferably on the flow-off side.

In a preferred embodiment of the invention, the jet regulator is constructed as a laminar jet regulator.

Other objects, advantages and novel features of the present invention will become apparent from the following detailed description of the invention when considered in conjunction with the accompanying drawings.

DETAILED DESCRIPTION OF THE INVENTION

Figures 1, 2, 3, 4:
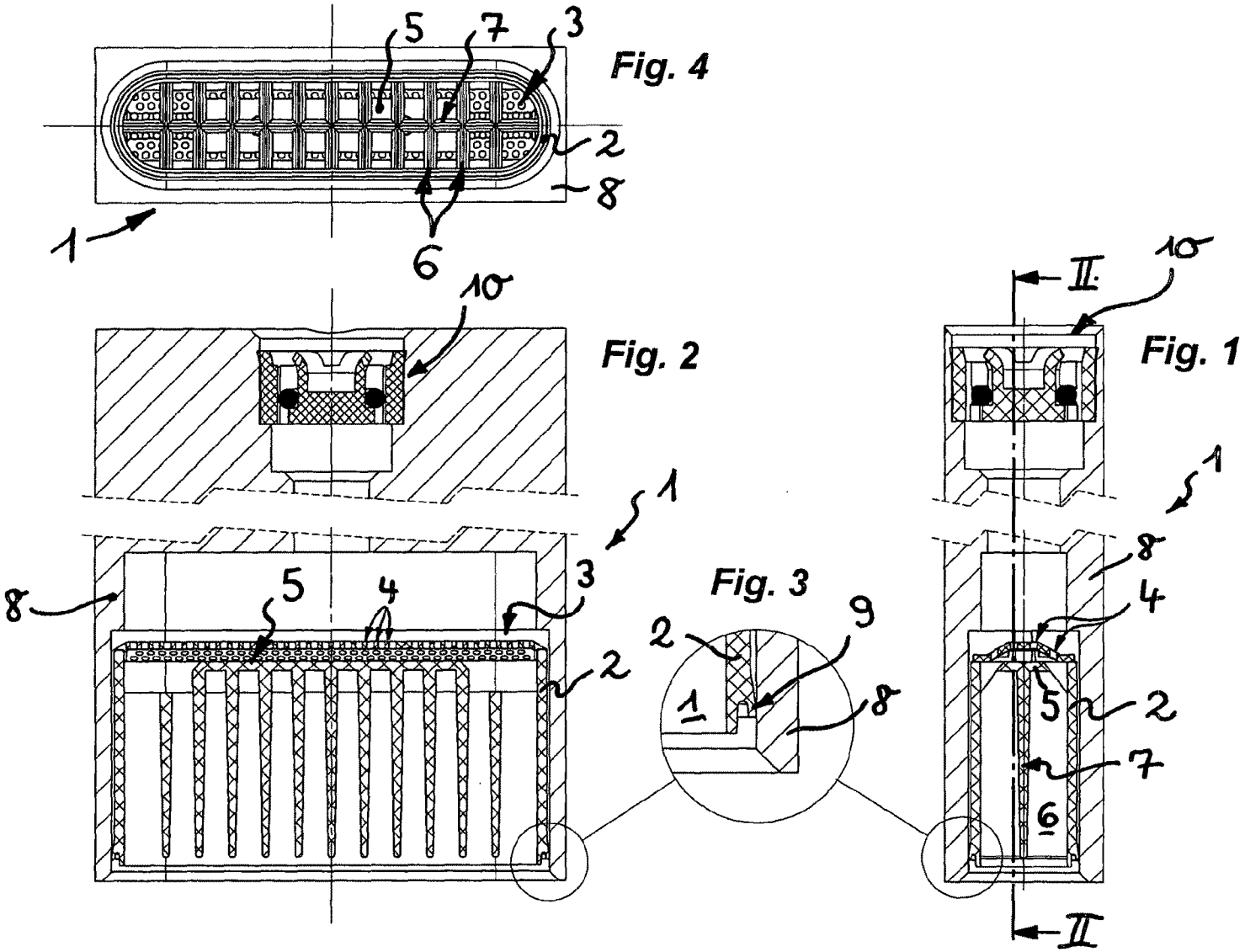
FIG. 1 is a longitudinal sectional view of a laminar jet regulator which is frictionally in the water outlet of a sanitary outlet fitting, with a flow regulator disposed at a distance in front of the jet regulator.
FIG. 2 is a sectional view along the intersection Line II-II of the jet regulator of FIG. 1.
FIG. 3 shows the jet regulator of FIG. 1 resting in a frictionally engaged manner on the inner periphery of the water outlet, in the region of a spring web molded on from the jet regulator housing on the outer periphery side.
FIG. 4 shows the jet regulator of FIGS. 1 to 3 situated in the water outlet of the sanitary outlet fitting, in a top view of its outlet front side.

FIGS. 1 to 6 illustrate a jet regulator 1 which is constructed as a laminar fan jet regulator, and has a sleeve-shaped jet regulator housing 2 whose clear cross-section has a length that is larger than its width. By means of the fan jet regulator 1 illustrated here, a band-shaped water jet is to be shaped that is dimensionally stable along a comparatively large distance and has a homogeneous and non-spraying jet pattern.

The jet regulator 1 has a distributor surface 3, which comprises a plurality of through-flow holes 4 and is constructed as a perforated plate, for distributing the water jet. The jet cross-section of the water jet that flows out of the distributor surface 3 in the present embodiment amounts to a multiple of the inflow-side jet cross-section. Since the distributor surface 3 merely distributes the water jet, but does not pose any excessively large resistance to it, no large holding forces that would be transmitted toward the fitting wall will build up, even in the case of a comparatively high inflow-side pressure of the inflowing medium.

A rebounding surface 5, which is arranged in a central region of the jet cross-section, and is connected downstream of the distributor surface 3, deflects the water jet from the central region into the edge regions of the clear through-flow cross-section. Flow guiding walls 6 are in turn connected downstream of the rebounding surface 5 in the flow direction and shape the flowing water into a uniform and homogenous flowing-out water jet. The jet regulator 1 illustrated here is therefore characterized by a homogenous jet pattern. Since the components 3, 5 and 6 of the jet regulator 1 do not pose any excessively large resistance to the water jet, the expenditures required for securing the jet regulator 1 in a housing can be reduced considerably.

FIGS. 1 and 2 illustrate that the jet regulator 1 is connected directly downstream of a cross-sectional expansion of the flow guide in the flow direction. In order to limit the water pressure acting upon the jet regulator 1, advantageously a flow regulator 10 is connected in front of the jet regulator 1—in a narrowed partial region of the flow guide.

Figure 5:
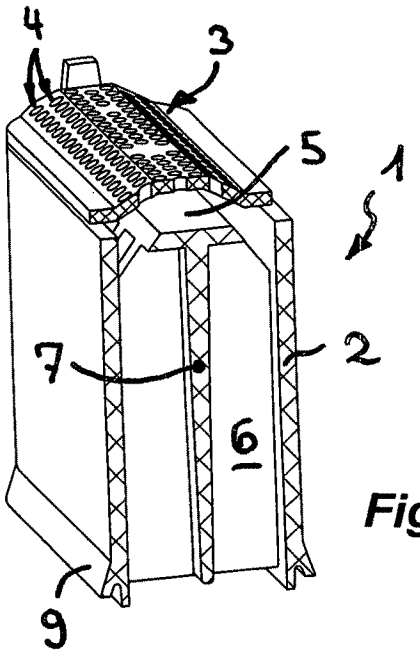
FIG. 5 is a partial perspective sectional view of the jet regulator of FIGS. 1 to 4.
Figure 6:
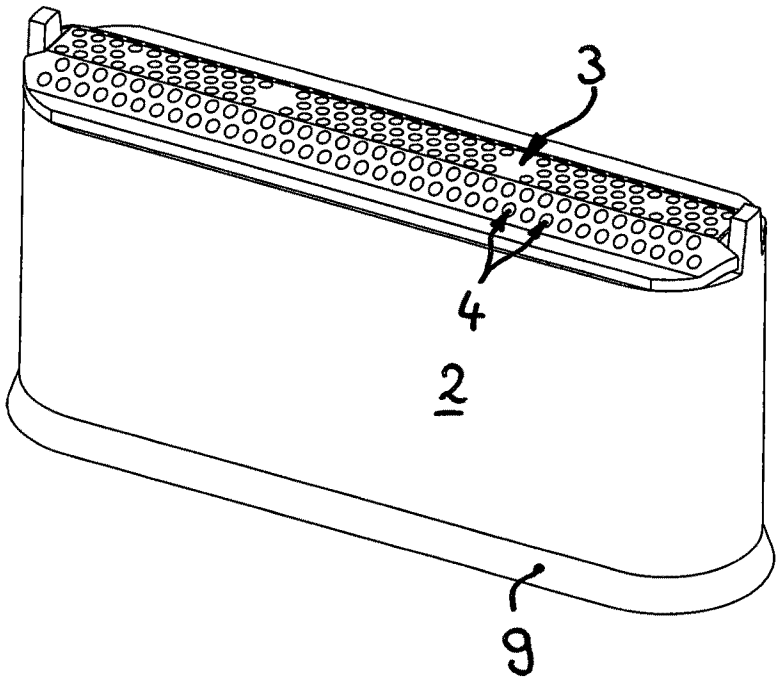
FIG. 6 is a perspective view of the jet regulator of FIGS. 1 to 5.

A comparison of FIGS. 1, 2 and 5 illustrates that the flow guiding walls 6 are arranged approximately parallel to one another, and are mutually connected by means of a central connecting wall 7 extending through the longitudinal center plane of the flow guiding walls 6. The connecting wall 7 and the flow guiding walls 6 taper in the flow direction, and are reach rounded at their flow-off-side narrow edges, in order to promote a homogenous jet pattern of the exiting water jet.

FIGS. 1, 2 and 5 also illustrate that the inner flow guiding walls 6 and the connecting wall 7 carry the rebounding surface 5. At least two opposite peripheral sides of the rebounding surface 5, and the inflow-side narrow edges of the flow guiding walls 6 projecting beyond the rebounding surface 5, have a truncated-cone-shaped side contour that is particularly easily recognizable in FIGS. 1 and 5.

FIG. 5 shows that the connecting wall 7 and the flow guiding walls 6 as well as the rebounding surface 5 molded thereto on the inflow side are arranged in the sleeve interior of the sleeve-shaped jet regulator housing 2, and are molded into the latter as one piece. In contrast, the distributor surface 3 is constructed as a perforated plate that can be placed onto the jet regulator housing 2.

The jet regulator housing 2 of the jet regulator illustrated herein can be releasably inserted together with its jet regulator housing 2 into the water outlet 8 of a sanitary outlet fitting, and held therein in a frictionally engaged manner in the use position. In order to secure this frictionally engaged connection between the jet regulator 1 and the inner of the jet regulator housing 2, a spring web 9, which acts upon the inner periphery of the water outlet 8, is provided on the outer periphery of the jet regulator housing 2. It may be advantageous for the spring web 9 to virtually also form-lockingly reach behind a narrow undercut at the inner periphery of the fitting housing. In an installed state, the spring web 9 is bent in the direction of the outlet front side, and rests (under prestress) against the inner periphery of the water outlet 8. Since the jet regulator 1 is constructed as an unaerated jet regulator, and a ring gap for the feeding of air is therefore not required between the outer periphery of the jet regulator housing and the inner periphery of the fitting, the jet regulator housing 2 rests virtually along its entire housing periphery against the inner periphery of the fitting housing.

The jet regulator 1 illustrated here provides a homogeneous jet pattern, and can be easily releasably inserted in the water outlet 8 of a sanitary outlet fitting also without additional fixing devices.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

The invention claimed is:

1. A jet regulator for accommodating a water flow, said jet regulator comprising:

a distributor surface having a plurality of through-flow holes for distributing the water flow;

a rebounding surface arranged in a central region of a flow cross-section; and a plurality of flow guiding walls connected downstream of the distributor surface, and oriented in a flow direction, wherein the flow guiding walls each have a longitudinal plane in the flow direction and the flow guiding walls are mutually connected by at least one central connecting wall extending through and perpendicular to the longitudinal planes of the flow guiding walls, wherein at least two opposite peripheral sides of the rebounding surface and/or inflow-side narrow edges of the flow guiding walls projecting beyond the rebounding surface have a truncated-cone-shaped side contour.

2. A jet regulator for accommodating a water flow, said jet regulator comprising:

a distributor surface having a plurality of through-flow holes for distributing the water flow;

a rebounding surface arranged in a central region of a flow cross-section; and a plurality of flow guiding walls connected downstream of the distributor surface, and oriented in a flow direction, wherein the flow guiding walls each have a longitudinal plane in the flow direction and the flow guiding walls are mutually connected by at least one central connecting wall extending through and perpendicular to the longitudinal planes of the flow guiding walls, wherein the at least one connecting wall and the flow guiding walls taper at least in a flow-off-side partial area and/or are rounded at their flow-off-side narrow edges.

3. A jet regulator for accommodating a water flow, said jet regulator comprising:

a distributor surface having a plurality of through-flow holes for distributing the water flow;

a rebounding surface arranged in a central region of a flow cross-section; and a plurality of flow guiding walls connected downstream of the distributor surface, and oriented in a flow direction, wherein the flow guiding walls each have a longitudinal plane in the flow direction and the flow guiding walls are mutually connected by at least one central connecting wall extending through and perpendicular to the longitudinal planes of the flow guiding walls, wherein the at least one connecting wall, flow guiding walls and the rebounding surface are arranged within a sleeve-shaped jet regulator housing and are molded in as a single piece, wherein the jet regulator further comprises at least one spring web provided on an outer periphery of the jet regulator housing, which is configured to act upon an inner periphery of a water outlet.

4. A jet regulator for accommodating a water flow, said jet regulator comprising:

a distributor surface having a plurality of through-flow holes for distributing the water flow;

a rebounding surface arranged in a central region of a flow cross-section; and a plurality of flow guiding walls connected downstream of the distributor surface, and oriented in a flow direction, wherein the flow guiding walls each have a longitudinal plane in the flow direction and the flow guiding walls are mutually connected by at least one central connecting wall extending through and perpendicular to the longitudinal planes of the flow guiding walls, wherein the at least one connecting wall, flow guiding walls and the rebounding surface are arranged within a sleeve-shaped jet regulator housing and are molded in as a single piece, wherein the jet regulator further comprises a surrounding spring web arranged on an outer periphery of the jet regulator housing, on a flow-off side.

5. A jet regulator for accommodating a water flow, said jet regulator comprising:

a jet regulator housing having peripherally extending exterior walls that surround a central interior portion of said housing, and form a flow path for accommodating said water flow;

a plurality of parallel flow guiding walls disposed in said interior portion of said housing, and extending in a direction of said water flow;

a distributor surface disposed across an open end of said housing, and having a plurality of through flow holes for distributing a water flow into said interior portion of said housing; and a rebounding surface supported on at least some of said flow guiding walls in said central interior portion of said housing, downstream of said distributor surface, and having lateral edges that deflect said water flow to edge regions of said flow path, between said rebounding surface and said exterior walls, wherein the flow guiding walls each have a longitudinal plane in the flow direction and the flow guiding walls are mutually connected by at least one central connecting wall extending through and perpendicular to the longitudinal planes the flow guiding walls, wherein said jet regulator housing has an exterior shape and dimension configured to accommodate a frictionally maintained mounting of said jet regulator in an interior of a sanitary outlet fitting, wherein said housing has on an outer surface thereof, a peripherally extending spring web that is adapted to engage an inner periphery of said sanitary outlet fitting.

6. The jet regulator according to claim 5, wherein said spring web is disposed around an outflow end of said housing.

7. The jet regulator according to claim 6, wherein said spring web has a shape and dimensions configured to lockingly engaging with a corresponding undercut on the interior of the sanitary outlet fitting.

* * * * *